US008535029B2

(12) United States Patent
Ohno et al.

(10) Patent No.: US 8,535,029 B2
(45) Date of Patent: Sep. 17, 2013

(54) SCROLL TYPE COMPRESSOR HAVING REINFORCED FIXED SCROLL

(75) Inventors: Masami Ohno, Aichi-ken (JP); Shinichi Sato, Aichi-ken (JP); Akio Saiki, Aichi-ken (JP); Shinsuke Asou, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 244 days.

(21) Appl. No.: 13/117,418

(22) Filed: May 27, 2011

(65) Prior Publication Data

US 2011/0300011 A1 Dec. 8, 2011

(30) Foreign Application Priority Data

Jun. 2, 2010 (JP) ..... 2010-126456

(51) Int. Cl.
*F01C 1/02* (2006.01)
*F03C 2/00* (2006.01)
*F03C 4/00* (2006.01)

(52) U.S. Cl.
USPC ..... 418/55.1; 418/55.2; 418/55.4; 418/55.5; 418/57

(58) Field of Classification Search
USPC ..... 418/55.1–55.6, 57, 94, 270, DIG. 1
See application file for complete search history.

(56) References Cited

U.S. PATENT DOCUMENTS 6,428,293 B1 * 8/2002 Dewar et al. ..... 418/55.1
6,641,379 B1 * 11/2003 Dewar et al. ..... 418/55.2

FOREIGN PATENT DOCUMENTS

JP 09032780 A * 2/1997
JP 09-273488 10/1997
JP 11-148470 6/1999
JP 2003083268 A * 3/2003
JP 2006-118511 5/2006
JP 2008133777 A * 6/2008
JP 2008202522 A * 9/2008

* cited by examiner

*Primary Examiner* — Theresa Trieu
(74) *Attorney, Agent, or Firm* — Greenblum & Bernstein, P.L.C.

(57) ABSTRACT

A scroll type compressor has a rotary shaft, a fixed scroll member, a movable scroll member and a rib. The fixed scroll member has a fixed end plate and a fixed scroll wall. The fixed end plate has first and second sides. The fixed scroll wall is formed on the first side. The movable scroll member has a movable end plate and a movable scroll wall. The movable scroll wall is formed on the movable end plate. The movable scroll member is adapted to make an orbital motion in accordance with the rotation of the rotary shaft whereby a compression chamber to decrease the volume of the compression chamber with the orbital motion of the movable scroll member is formed between the fixed scroll member and the movable scroll member. The rib is provided on the second side so as to extend behind the inner end of the fixed scroll wall.

6 Claims, 8 Drawing Sheets

SCROLL TYPE COMPRESSOR HAVING REINFORCED FIXED SCROLL

BACKGROUND OF THE INVENTION

The present invention relates to a scroll type compressor.

In general, a scroll type compressor includes a fixed scroll member having a fixed end plate and a fixed scroll wall and a movable scroll member having a movable end plate and a movable scroll wall. The fixed and the movable scroll members are disposed in a housing of the compressor with the scroll walls thereof engaged with each other. The movable scroll member orbits around the axis of the fixed scroll member and refrigerant gas drawn into a compression chamber formed between the fixed and the movable scroll walls of the scroll members is compressed with a decrease in the volume of the compression chamber in accordance with the orbital motion of the movable scroll member relative to the fixed scroll member.

Japanese Patent Application Publications H9-273488 and H11-148470 disclose a scroll type compressor that has a rib provided on the side of the fixed end plate that is opposite from the side thereof where the fixed scroll wall is formed. Japanese Patent Application Publication H9-273488 disclose a scroll type compressor having a first rib provided at the center on one side of the fixed end plate, a plurality of second ribs provided on the same side of the fixed end plate and extending radially from the first rib and a third rib provided adjacently to the outer periphery of the fixed end plate and connected with the second ribs. Japanese Patent Application Publication H11-148470 disclose a scroll type compressor having a first rib provided on one side of the fixed end plate so as to surround the discharge port and a plurality of second ribs extending radially from the first rib.

In the scroll type compressors of the above Publications, the compression chamber formed between the fixed and the movable scroll walls of the scroll members is moved toward the center while reducing its volume in accordance with the orbital motion of the movable scroll member. Refrigerant in the compression chamber is compressed and discharged out therefrom through the discharge port into a discharge chamber. The compressed and hence high-pressure refrigerant is used in the refrigerant circuit for the air conditioning. The ribs in the scroll type compressors disclosed in the above-cited Publications prevent the fixed scroll member from being deformed by the compressed high-pressure refrigerant.

Japanese Patent Application Publication 2006-118511 discloses a scroll type compressor that has the discharge chamber and an oil storage chamber between the housing and the fixed scroll member. In this scroll type compressor, the discharge chamber and the oil storage chamber are separated from each other by a separation wall formed behind the fixed end plate and a separation wall formed in the front of the housing.

In a scroll type compressor, it is difficult to strike a balance between increasing the amount of the refrigerant discharged per one orbital motion of the movable scroll member and the on-board capability.

If the winding angle of the fixed scroll wall and the movable scroll wall is increased with an attempt to increase the amount of the refrigerant discharged per one orbital motion of the movable scroll member, the size of the compressor is enlarged only for the sacrifice of the on-board capability. Meanwhile, if the height of the fixed scroll wall and the movable scroll wall is enlarged with an attempt to increase the amount of the refrigerant discharged per one orbital motion of the movable scroll member, there is a fear that the strength of the center portion of the movable scroll member and fixed scroll member may be impaired. If the thickness of the fixed end plate and the movable end plate is enlarged for the increasing the strength of the center portion of the movable scroll member and fixed scroll member, the size of the compressor is enlarged and, therefore, the on-board capability is impaired.

In the scroll type compressor of the above Publication, the rib or the separation wall of the fixed end plate is provided irrespective of the inner end of the fixed scroll wall. Therefore, there has been a problem in that the size of the compressor is enlarged and the on-board capability is decreased.

The present invention is directed to providing a scroll type compressor that can strike a balance between increasing the amount of refrigerant discharged per one orbital motion of the movable scroll member and the on-board capability.

SUMMARY OF THE INVENTION

A scroll type compressor has a rotary shaft, a fixed scroll member, a movable scroll member and a rib. The fixed scroll member has a fixed end plate and a fixed scroll wall. The fixed end plate has first and second sides. The fixed scroll wall is formed on the first side. The movable scroll member has a movable end plate and a movable scroll wall. The movable scroll wall is formed on the movable end plate. The movable scroll member is adapted to make an orbital motion in accordance with the rotation of the rotary shaft whereby a compression chamber to decrease the volume of the compression chamber with the orbital motion of the movable scroll member is formed between the fixed scroll member and the movable scroll member. The rib is provided on the second side at an opposite area where the inner end of the fixed scroll wall is located.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which;

DETAILED DESCRIPTION OF THE PREFERRED EMBODIMENTS

Figure 1:
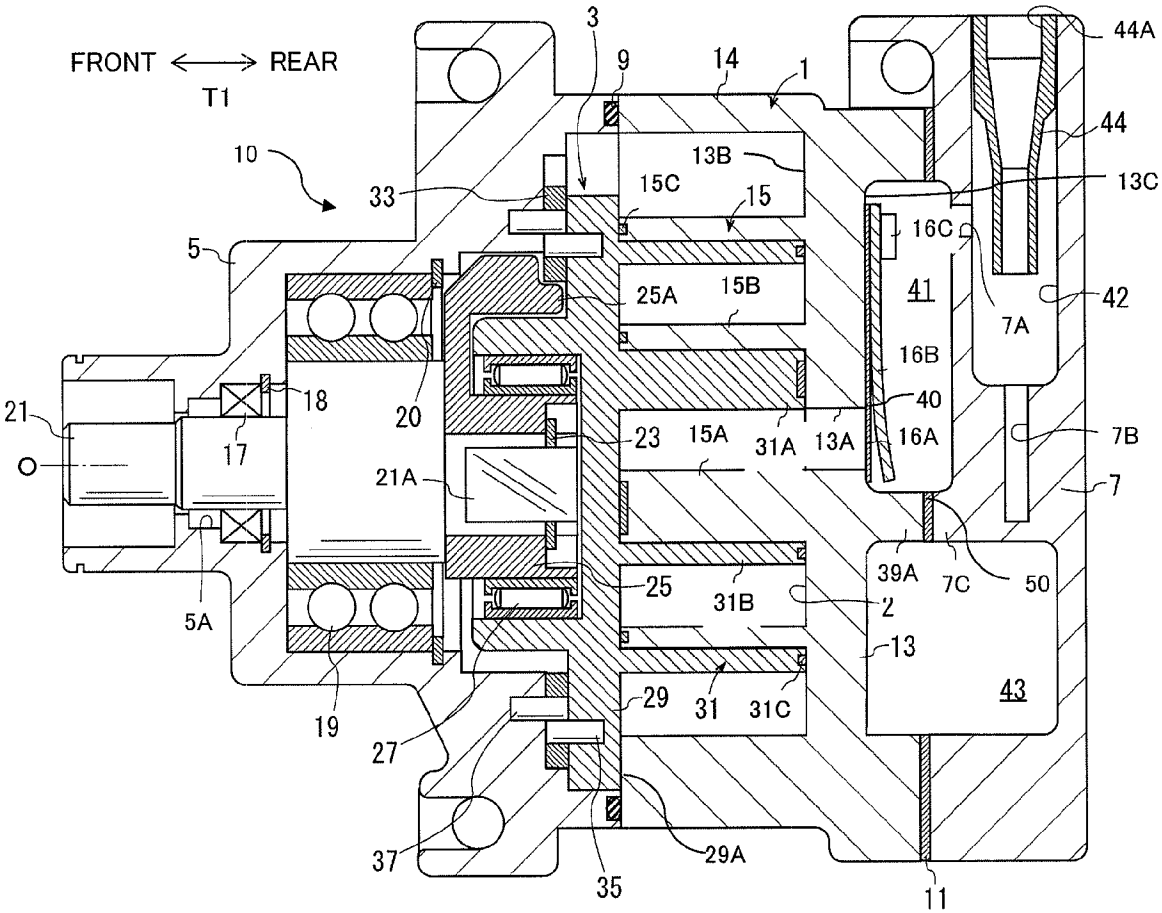
FIG. 1 is a longitudinal sectional view of a scroll type compressor according to a first embodiment of the present invention.
Figure 2:
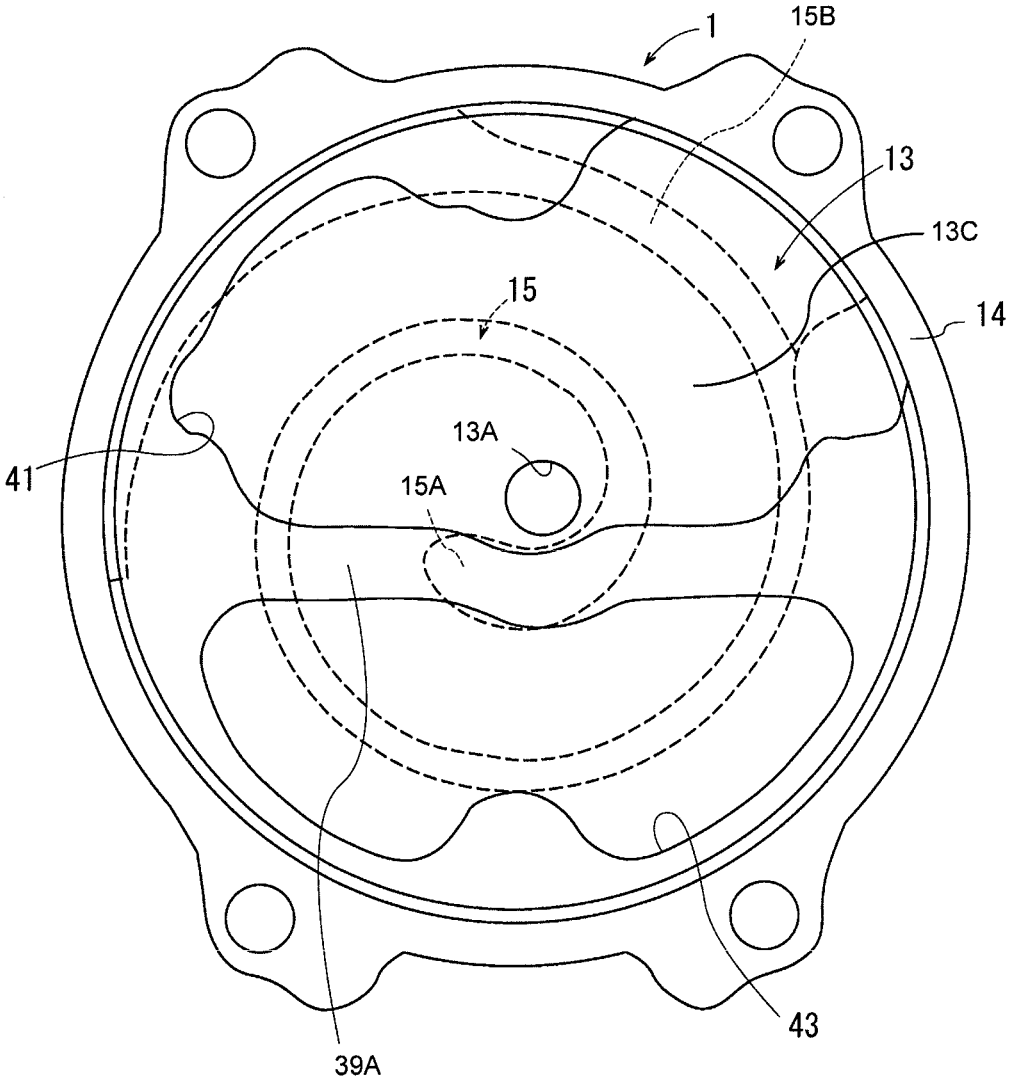
FIG. 2 is a rear view of a fixed scroll member of the scroll type compressor of FIG. 1.

The following will describe the first embodiment of a scroll type compressor used for a vehicle air conditioner according to the present invention with reference to FIGS. 1 and 2. In the following description, the references to directions of front and rear are indicated by double-head arrow T1 in FIG. 1.

Referring to FIG. 1, the scroll type compressor 10 (hereinafter simply referred to simply as compressor) includes a front housing 5, a fixed scroll member 1 and a rear housing 7. The front housing 5, the fixed scroll member 1 and the rear housing 7 are fixed to each other by a plurality of bolts (not shown). An O-ring 9 is disposed between the front housing 5 and the fixed scroll member 1. A gasket 11 is arranged between the rear housing 7 and the fixed scroll member 1.

The front housing 5 has formed therethrough a shaft hole 5A. A rotary shaft 21 is rotatably mounted in the shaft hole 5A of the front housing 5 through a seal device 17 and a bearing 19. The seal device 17 and the bearing 19 are retained by snap rings 18, 20 in the shaft hole 5A, respectively. The rotary shaft 21 has an eccentric key 21A that is offset from the center axis O of the rotary shaft 21. The eccentric key 21A is fitted in a bush 25 and retained by a circlip 23. The bush 25 is formed integrally with a counterweight 25A. A movable scroll member 3 is rotatably supported by the bush 25 through a bearing 27.

The fixed scroll member 1 includes a disk-shaped fixed end plate 13 disposed perpendicularly to the center axis O and having the front side 13B as a first side of the fixed end plate 13, a fixed scroll wall 15 extending frontward from the front side 13B and a fixed peripheral wall 14 extending frontward from the periphery of the front side 13B of the fixed end plate 13. As shown in FIG. 2, the fixed scroll wall 15 is formed extending spirally from the inner end 15A to the outer end 15B on the fixed scroll wall 15, e.g., along an involute curve. The inner end 15A is the initial part of the spiral curve of the fixed scroll wall 15. The fluid pressure adjacent to the inner end 15A is highest, so that the inner end 15A of the fixed scroll wall 15 is formed thicker than the outer end 15B. The surface of the inner end 15A is rounded, as shown in FIG. 2. As shown in FIG. 1, a tip seal 15C is provided in the tip of the fixed scroll wall 15.

The movable scroll member 3 includes a disk-shaped movable end plate 29 extending perpendicularly to the center axis O, a movable scroll wall 31 extending rearward from the rear side 29A of the movable end plate 29 and having an outer end 31B. The movable scroll wall 31 is formed extending spirally from the inner end 31A to the outer end 31B on the movable scroll wall 31, e.g., along an involute curve. The fluid pressure adjacent to the inner end 31A is highest, so that the inner end 31A of the movable scroll wall 31 is formed thicker than the outer end 31B. A tip seal 31C is provided in the tip of the movable scroll wall 31. The movable scroll wall 31 of the movable scroll member 3 engages with the fixed scroll wall 15 of the fixed scroll member 1, thus a compression chamber 2 being defined by the fixed end plate 13, the fixed scroll wall 15, the movable end plate 29 and the movable scroll wall 31.

A plurality of stationary pins 37 is fixed in the rear end of the front housing 5 in parallel relation to the center axis O. The same number of movable pins 35 as the stationary pins 37 is fixed in the movable end plate 29 in parallel relation to the center axis O. The same number of rings 33 as the stationary pins 37 is provided between the front housing 5 and the movable end plate 29. Each stationary pin 37 is disposed with one end thereof inserted in the front housing 5 and the other end thereof inserted through its corresponding ring 33. Each movable pin 35 disposed with one end thereof inserted in the movable end plate 29 and the other end thereof inserted through its corresponding ring 33. The stationary pins 37, the movable pins 35, and the rings 33 cooperate to form a rotation preventing mechanism that prevents the rotation of the movable scroll member 3 on its axis and allows the movable scroll member 3 to orbit around the center axis O.

The fixed scroll member 1 and the rear housing 7 define therebetween a discharge chamber 41 and an oil storage chamber 43. An oil separation chamber 42 is formed in the rear housing 7. The fixed end plate 13 has formed therethrough at a position adjacent to the inner end 15A of the fixed scroll wall 15 a discharge port 13A. The discharge chamber 41 is communicable through the discharge port 13A with the innermost compression chamber 2. The discharge port 13A has an opening 40 in a rear side 13C as a second side of the fixed end plate 13. The discharge port 13A is opened and closed by a discharge valve 16A which is fixed to the rear side 13C of the fixed end plate 13 by a pin 16C. Opening of the discharge valve 16A is regulated by a retainer 16B fixed to the rear side 13C by the pin 16C.

The oil separation chamber 42 is formed cylindrical, and an oil separator 44 is provided in the oil separation chamber 42. The discharge chamber 41 communicates with the oil separation chamber 42 through a communication hole 7A. The communication hole 7A is formed in facing relation to the oil separator 44. An outlet port 44A is provided to the upper end of the oil separator 44. The oil separation chamber 42 communicates with an external refrigerant circuit (not shown) through the outlet port 44A. The external refrigerant circuit includes a condenser, an expansion valve, and an evaporator and communicates with an inlet port (not shown) of the compressor 10.

The oil separation chamber 42 is in communication with the oil storage chamber 43 through a communication hole 7B. It is so arranged that oil in the oil storage chamber 43 is supplied to the sliding surfaces between the fixed scroll wall 15 and the movable end plate 29 and also between the movable scroll wall 31 and the fixed end plate 13 through an oil supply passage (not shown).

As shown in FIG. 2, the fixed end plate 13 is formed integrally therewith on the rear side 13C thereof with a rib 39A that projects rearward from the fixed end plate 13 and extends substantially radially to the outer periphery of the fixed end plate 13 and also behind the inner end 15A of the fixed scroll wall 15 without surrounding the discharge port 13A. The opening 40 is arranged between an end portion 50 of the rib 39A and the compression chamber 2. As shown in FIG. 1, the rear housing 7 is formed integrally therewith an auxiliary rib 7C so as to support the rib 39A from behind through the gasket 11. The oil storage chamber 43 is separated from the discharge chamber 41 by the rib 39A and the auxiliary rib 7C. Illustration of the discharge valve 16A, the retainer 16B, and the pin 16C is omitted in FIG. 2. The same holds true of FIGS. 3-8 which will be described hereinafter.

The rotary shaft 21 is driven by a pulley (not shown) through an electromagnetic clutch (not shown). When the rotary shaft 21 is rotated, the movable scroll member 3 orbits around the center axis O through the eccentric key 21A, the bush 25, and the rotation preventing mechanism. Refrigerant gas is introduced into a compression chamber 2 through a suction port (not shown), and compressed with a decrease in the volume of the compression chamber 2 in accordance with the orbital motion of the movable scroll member 3. After being compressed to the desired pressure in the center of the compression chamber 2, the refrigerant gas is discharged into the discharge chamber 41 through the discharge port 13A.

The refrigerant gas in the discharge chamber 41 is flowed into the oil separation chamber 42 through the communication hole 7A. The oil contained in the refrigerant gas is separated therefrom in the oil separation chamber 42 and flowed into the oil storage chamber 43 through the communication hole 7B. The refrigerant gas having separated the oil therefrom is supplied to the refrigerant circuit to be used for air conditioning the vehicle.

The inner end 15A and the rib 39A provided on the rear side 13C of the fixed end plate 13 so as to extend behind the inner end 15A of the fixed scroll wall 15, as shown in FIG. 2, cooperate to reinforce the fixed end plate 13 with the inner end 15A. Therefore, the fixed end plate 13 can be formed less thick than in the prior art and the compressor 10 can be made smaller in the axial length, accordingly.

Consequently, the dimensions of the fixed scroll wall 15 and the movable scroll wall 31 as measured in axial direction of the compressor may be increased without enlarging the winding angle of the fixed scroll wall 15 and the movable scroll wall 31, as shown in FIG. 1, the amount of the refrigerant discharged per one orbital motion of the movable scroll member 3 can be increased. It is also possible to prevent the compressor on-board capability from being decreased due to an increased axial length of the fixed end plate 13.

The arrangement of the rib 39A that extends around the discharge port 13A helps to prevent an increase of the axial length of the discharge port 13A. The dead volume of the compression chamber 2 is reduced, thus further improving the efficiency of the compressor.

The rib 39A extending to the outer periphery of the fixed end plate 13 serves to additionally reinforce the end plate 13. Furthermore, the thickness of the fixed end plate 13 can be additionally reduced, so that the axial length of the compressor 10 can be additionally reduced.

The auxiliary rib 7C provided on the rear housing 7 to support the rib 39A through the gasket 11 cooperate with the rib 39A to additionally reinforce the end plate 13. Furthermore, the thickness of the fixed end plate 13 can be additionally reduced and the axial length of the compressor 10 can be additionally reduced, accordingly.

The oil storage chamber 43 is separated from the discharge chamber 41 by the rib 39A and the auxiliary rib 7C, so that the rib 39A functions as a separation wall separating the oil storage chamber 43 from the discharge chamber 41. It is not necessary to provide a separation wall in addition to the rib 39A.

Figure 3:
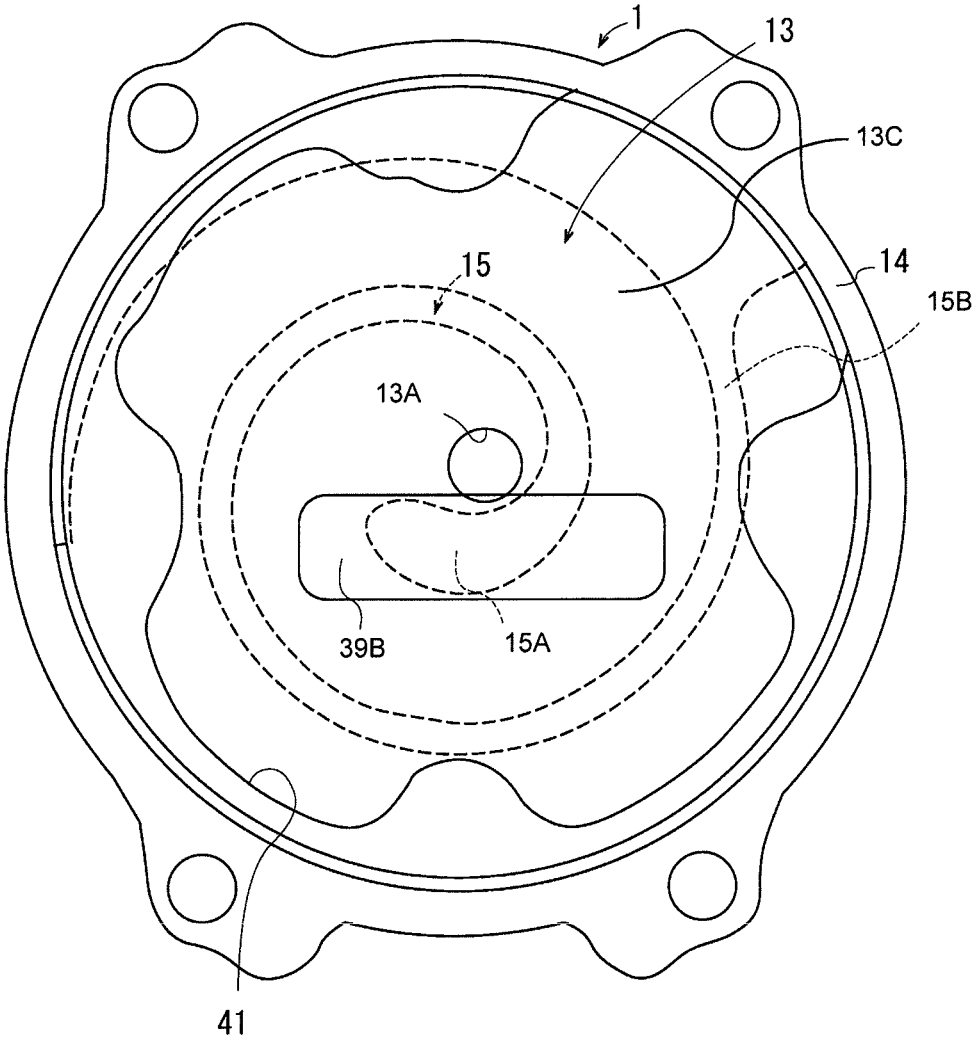
FIG. 3 is a rear view of a fixed scroll member of a scroll type compressor according to a second embodiment of the present invention.

The following will describe the second embodiment according to the present invention with reference to FIG. 3. The following description will use the same reference numerals for the common elements or components in the first and the second embodiments, and the description of such elements and components in FIG. 3 for the second embodiment will be omitted. As shown in FIG. 3, the scroll type compressor of the second embodiment differs from the counterpart of the first embodiment in that the fixed end plate 13 is formed integrally therewith on the rear side 13C thereof with an island shaped rib 39B. Only the discharge chamber 41 is formed in the surroundings of the rib 39B. The rib 39B is formed with a thickness in the radial direction that is larger than the thickness of the inner end 15A in the radial direction.

Unlike the rib 39A in the first embodiment, the rib 39B does not extend to the outer periphery of the fixed end plate 13. The rib 39B of the second embodiment is formed thick enough to reinforce the fixed end plate 13. The rest of the effects according to the second embodiment are same as those according to the first embodiment.

Figure 4:
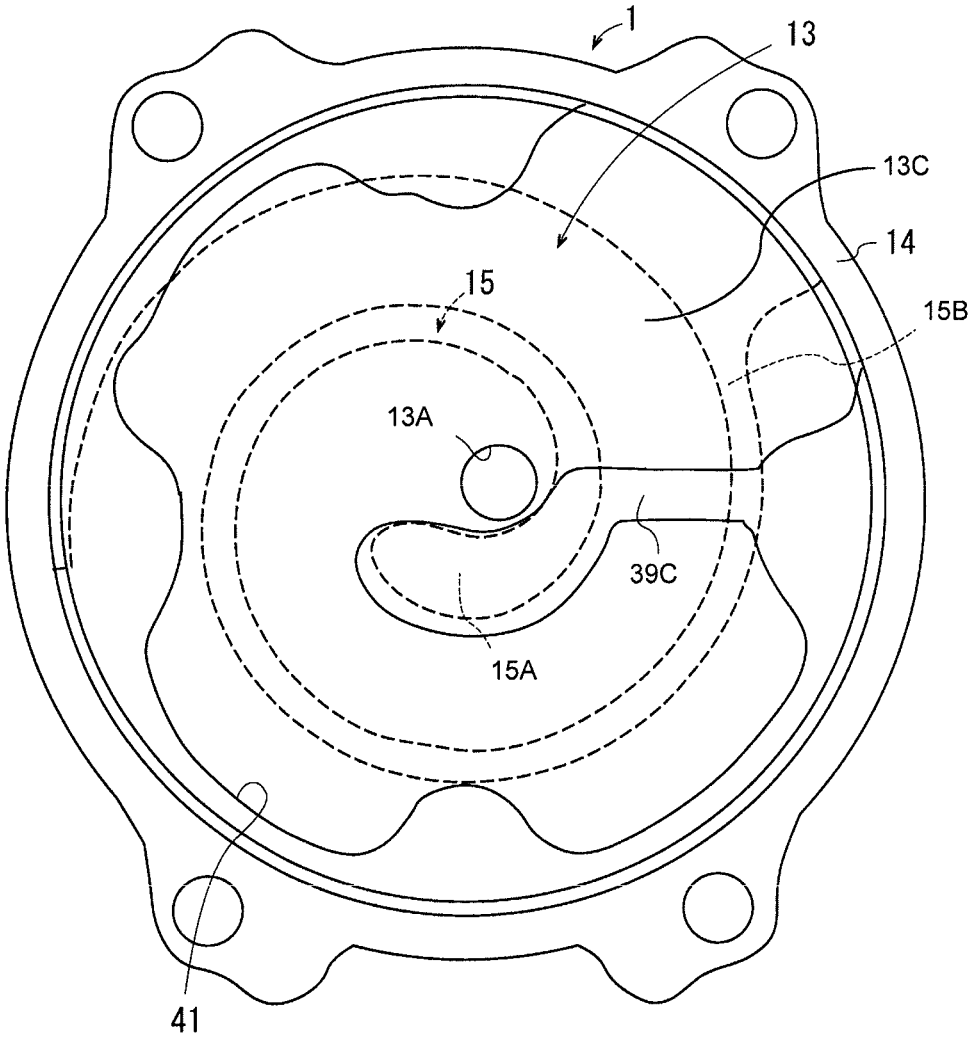
FIG. 4 is a rear view of a fixed scroll member of a scroll type compressor according to a third embodiment of the present invention.

The following will describe the third embodiment according to the present invention with reference to FIG. 4. The following description will use the same reference numerals for the common elements or components in the first and the third embodiments, and the description of such elements and components in FIG. 4 for the third embodiment will be omitted. As shown in FIG. 4, the fixed end plate 13 is formed integrally therewith on the rear side 13C thereof with a rib 39C. One end of the rib 39C is formed arcuate and arranged along the inner end 15A of the fixed scroll wall 15. The other end of the rib 39C extends to the outer periphery of the fixed end plate 13. Only the discharge chamber 41 is formed in the surroundings of the rib 39C.

The rib 39C having the other end thereof extending to the outer periphery of the fixed end plate 13 is strong enough to reinforce the fixed end plate 13. Furthermore, the rib 39C having the one end thereof arranged along the inner end 15A has a strength that is enough to reinforce the fixed end plate 13. The rest of the effects according to the third embodiment are same as those according to the first embodiment.

Figure 5:
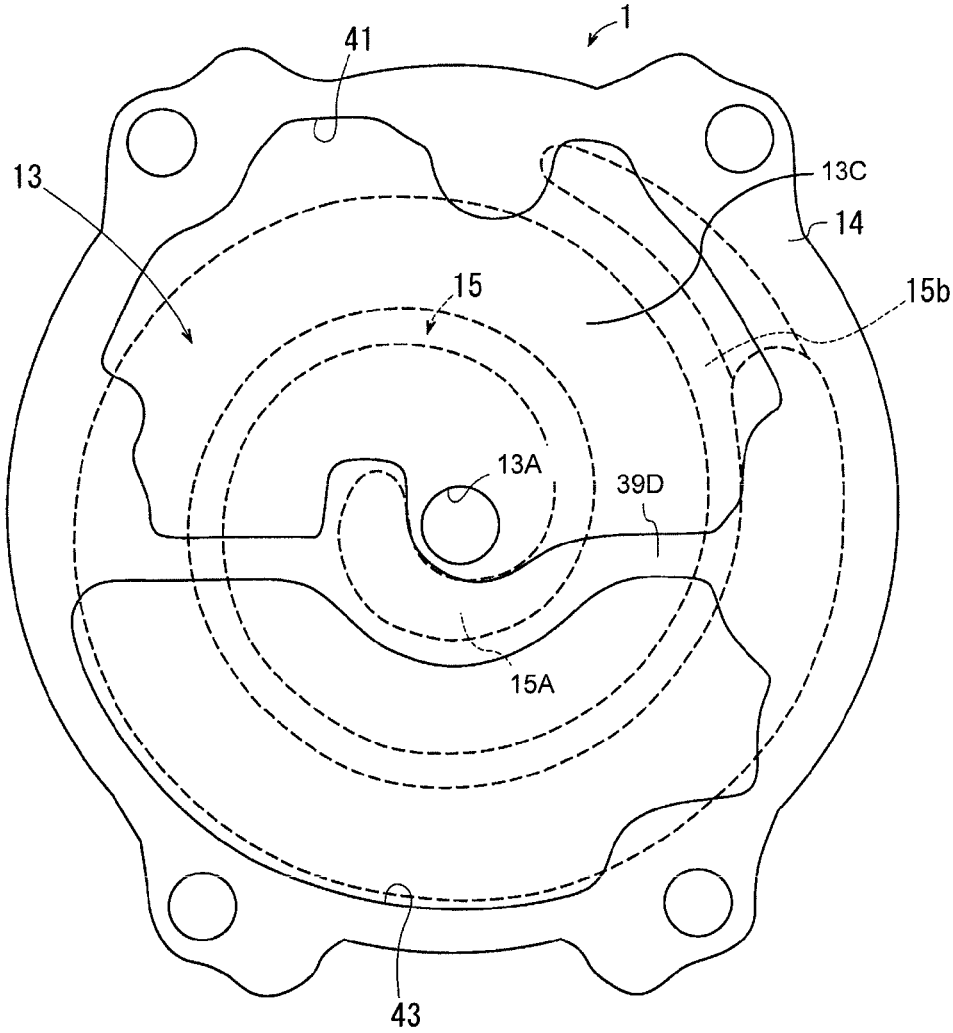
FIG. 5 is a rear view of a fixed scroll member of a scroll type compressor according to a fourth embodiment of the present invention.

The following will describe the fourth embodiment according to the present invention with reference to FIG. 5. The following description will use the same reference numerals for the common elements or components in the first and fourth embodiments, and the description of such elements and components in FIG. 5 for the fourth embodiment will be omitted. As shown in FIG. 5, the fixed end plate 13 is formed integrally therewith on the rear side 13C thereof with a rib 39D. The rib 39D includes a center portion that is substantially formed arcuate and arranged along the inner end 15A of the fixed scroll wall 15 and substantially straight portions that extend in opposite directions from the center portion to the outer periphery of the fixed end plate 13. The oil storage chamber 43 is separated from the discharge chamber 41 by the rib 39D. The fixed end plate 13 is reinforced enough by the rib 39D. The rest of the effects according to the fourth embodiment are same as those according to the first and third embodiments.

Figure 6:
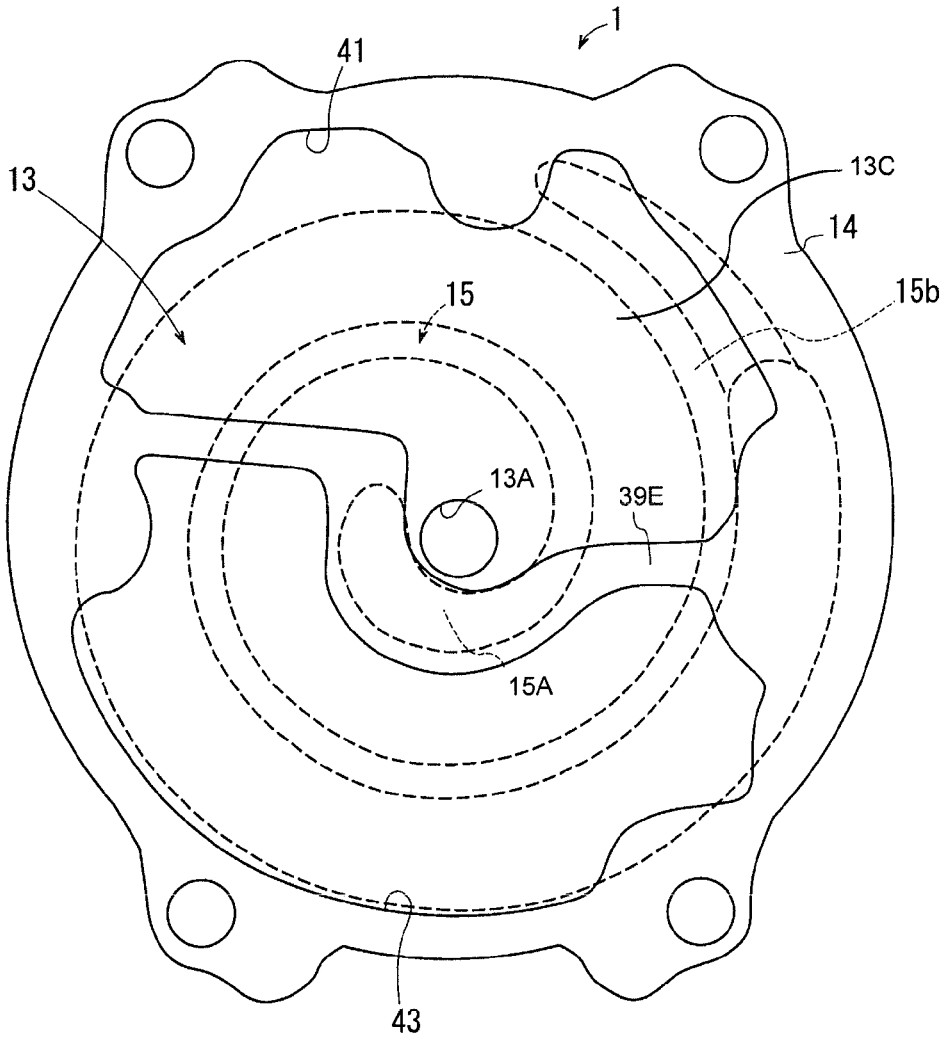
FIG. 6 is a rear view of a fixed scroll member of a scroll type compressor according to a fifth embodiment of the present invention.

The following will describe the fifth embodiment according to the present invention with reference to FIG. 6. The following description will use the same reference numerals for the common elements or components in the first and fifth embodiments, and the description of such elements and components in FIG. 6 for the fifth embodiment will be omitted. As shown in FIG. 6, the shape of a rib 39E of the fifth embodiment is different from that of the rib 39D of the fourth embodiment. Specifically, the rib 39E has a center portion that is formed arcuate and arranged along the inner end 15A of the fixed scroll wall 15 and substantially straight portions extending from the opposite ends of the arcuate center portion of the rib 39E to the outer periphery of the fixed end plate 13. The oil storage chamber 43 is separated from the discharge chamber 41 by the rib 39E.

The rib 39E having the opposite ends thereof connected to the outer periphery of the fixed end plate 13 reduces the load at the ends as compared with the rib 39D of the fourth embodiment and reinforces the fixed end plate 13, accordingly. The rest of the effects according to the fourth embodiment are same as those according to the first and third embodiments.

Figure 7:
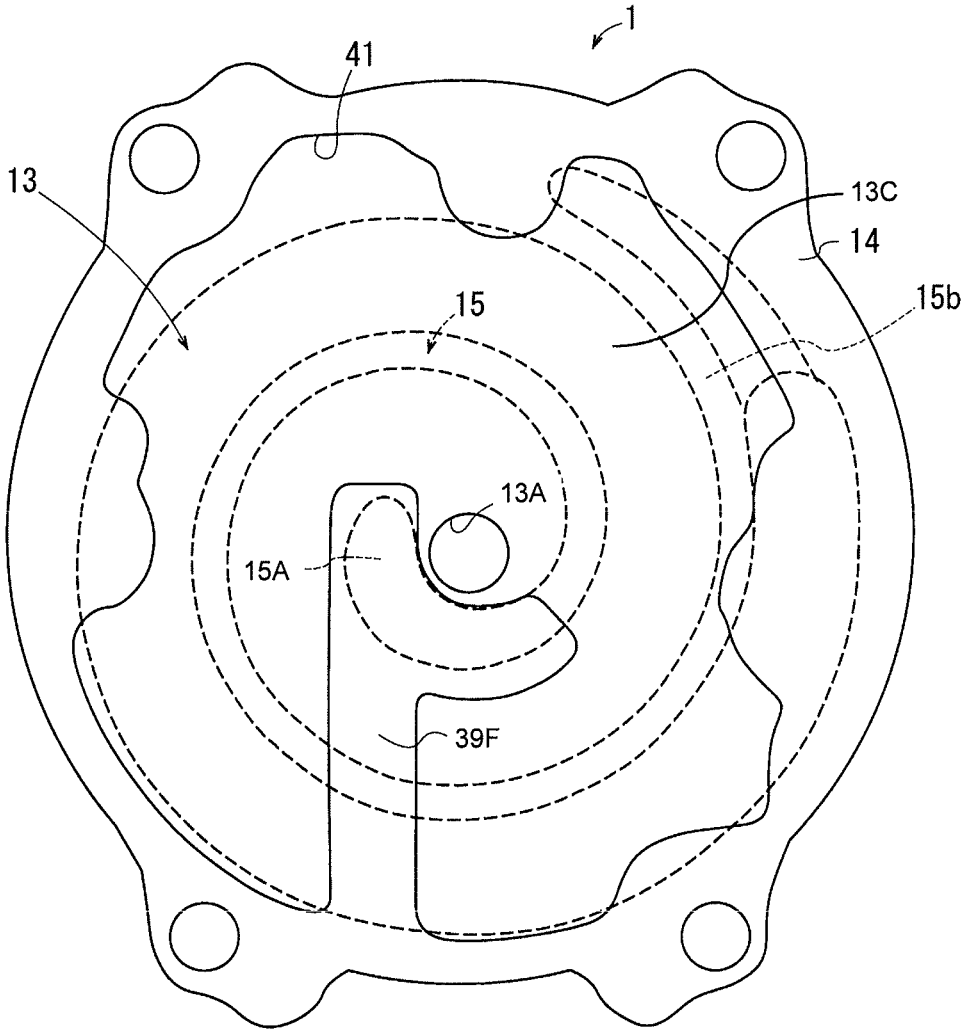
FIG. 7 is a rear view of a fixed scroll member of a scroll type compressor according to a sixth embodiment of the present invention.

The following will describe the sixth embodiment according to the present invention with reference to FIG. 7. The following description will use the same reference numerals for the common elements or components in the first and sixth embodiments, and the description of such elements and components in FIG. 7 for the sixth embodiment will be omitted. As shown in FIG. 7, the fixed end plate 13 is formed integrally therewith on the rear side 13C thereof with a rib 39F. Specifically, the rib 39F has a center portion that is formed arcuate and arranged along the inner end 15A of the fixed scroll wall 15 and a straight portion that extends from the center arcuate portion to the outer periphery of the fixed end plate 13. Only the discharge chamber 41 is formed in the surroundings of the rib 39F. The fixed end plate 13 is reinforced enough by the rib 39F. The rest of the effects according to the fourth embodiment are same as those according to the first and third embodiments.

Figure 8:
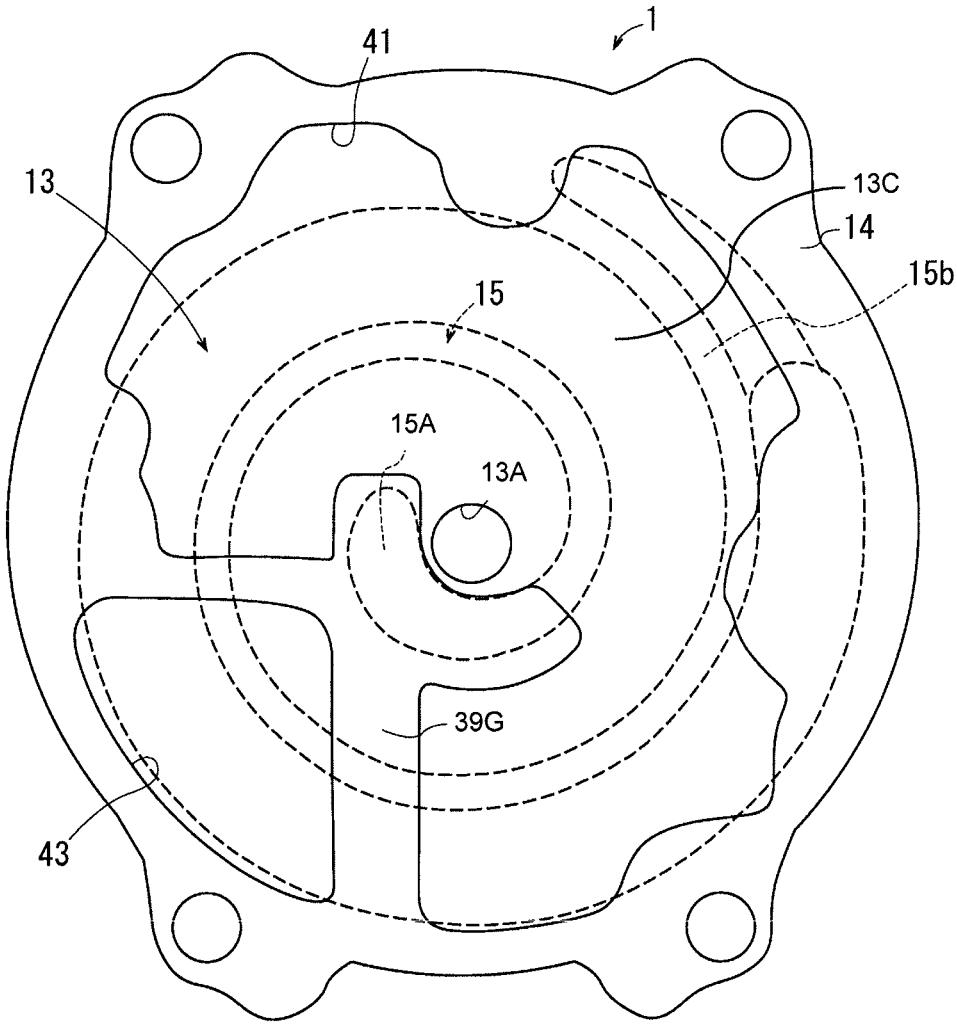
FIG. 8 is a rear view of a fixed scroll member of a scroll type compressor according to a seventh embodiment of the present invention.

The following will describe the seventh embodiment according to the present invention with reference to FIG. 8. The following description will use the same reference numerals for the common elements or components in the first and seventh embodiments, and the description of such elements and components in FIG. 8 for the seventh embodiment will be omitted. As shown in FIG. 8, the shape of a rib 39G is different from the shape of the rib 39F. Specifically, the rib 39G has a center portion that is formed arcuate and arranged along the inner end 15A and two straight portions extending from the arcuate center portion to the outer periphery of the fixed end plate 13, respectively. The two straight portions of the rib 39G extend in perpendicular relation to each other. The oil storage chamber 43 is separated from the discharge chamber 41 by the rib 39G The fixed end plate 13 is reinforced enough by the rib 39G. The rest of the effects according to the fourth embodiment are same as those according to the first and third embodiments.

The above embodiments may be modified in various ways as exemplified below.

In the above-described embodiments, the rotary shaft 21 is driven by the pulley through the electromagnetic clutch. Alternatively, the rotary shaft 21 may be driven by an electric motor provided in the compressor.

In the above-described embodiments, the inner ends 15A, 31A of the fixed scroll wall 15 and the movable scroll wall 31 are formed thicker than the outer ends 15B, 31B. Alternatively, the inner ends 15A, 31A may be formed otherwise.

Therefore, the present examples and embodiments are to be considered as illustrative and not restrictive and the invention is not to be limited to the details given herein but may be modified within the scope of the appended claims.

What is claimed is:

1. A scroll type compressor comprising:

a rotary shaft;

a fixed scroll member including a fixed end plate having first and second sides, and further including a fixed scroll wall formed on the first side, wherein the fixed scroll wall spirally extends from a radially inner end adjacent a radial center of the fixed end plate to a radially outer end adjacent an outer periphery of the fixed end plate;

a movable scroll member including a movable end plate and a movable scroll wall formed on the movable end plate, wherein the movable scroll member is adapted to make an orbital motion in accordance with the rotation of the rotary shaft whereby a compression chamber to decrease the volume of the compression chamber with the orbital motion of the movable scroll member is formed between the fixed scroll member and the movable scroll member; and a rib provided on the second side so as to extend behind and in at least partial alignment with the radially inner end of the fixed scroll wall in a rotation axis direction of the rotary shaft.

2. The compressor according to claim 1 further including:

a housing fixed to the fixed scroll member, a discharge chamber defined by the housing and the fixed scroll member, a discharge port bored through the fixed end plate, the discharge port connects the compression chamber to the discharge chamber, wherein the discharge port has an opening in the second side of the fixed end plate, wherein the opening is arranged between an end portion of the rib and the compression chamber, a discharge valve opens or closes the opening.

3. The compressor according to claim 2, wherein the housing is connected to the end portion of the rib.

4. The compressor according to claim 3 further including:

an oil storage chamber defined by the housing and the fixed scroll member and separated from the discharge chamber by the rib.

5. The compressor according to claim 2, wherein the discharge chamber is provided eccentric to a rotation axis of the rotary shaft.

6. The compressor according to claim 1, wherein the rib extends to the periphery of the fixed end plate.

* * * * *